United States Patent [19]

Niimi et al.

[11] Patent Number: 4,501,243

[45] Date of Patent: Feb. 26, 1985

[54] AIR-FUEL RATIO CONTROL APPARATUS

[75] Inventors: Yukihide Niimi; Kenzi Kinoshita, both of Kariya; Masahiro Urushidani, Toyota, all of Japan

[73] Assignees: Nippondenso Co., Ltd., Kariya; Toyota Jidosha Kabushiki Kaisha, Toyota, both of Japan

[21] Appl. No.: 489,949

[22] Filed: Apr. 29, 1983

[30] Foreign Application Priority Data

Apr. 30, 1982 [JP] Japan ..... 57-72860

[51] Int. Cl.[3] ..... F02M 7/10

[52] U.S. Cl. ..... 123/440

[58] Field of Search ..... 123/438, 440, 478, 489, 123/589

[56] References Cited

U.S. PATENT DOCUMENTS

| | | | |
|---|---|---|---|
| 3,916,170 | 10/1975 | Norimatsu et al. | 123/489 |
| 4,241,710 | 12/1980 | Peterson, Jr. et al. | 123/489 |
| 4,385,608 | 5/1983 | Ohgami et al. | 123/440 |
| 4,430,979 | 2/1984 | Shikata | 123/489 |

*Primary Examiner*—Parshotam S. Lall
*Assistant Examiner*—W. R. Wolfe
*Attorney, Agent, or Firm*—Cushman, Darby & Cushman

[57] ABSTRACT

In an air-fuel ratio control apparatus for engines, when a vehicle is brought to a stop and the engine comes into an idling operation, the average value of air-fuel ratio correction amount is decreased by a given amount and the air-fuel ratio control is started again from the decreased value by means of an average value hold circuit.

7 Claims, 3 Drawing Figures

AIR-FUEL RATIO CONTROL APPARATUS

BACKGROUND OF THE INVENTION

The present invention relates to an air-fuel ratio control apparatus for internal combustion engines.

Air-fuel ratio control apparatus are known in the art in which when a vehicle decelerates from its steady-state condition and comes to a stop, that is, when the engine is placed in its idle mode of operation, the air-fuel ratio control is switched to an open loop control so that the air-fuel ratio correction amount is held at the average value of the air-fuel ratio correction amount during the starting period of the engine idling operation and the air-fuel ratio control is stopped. Thus there is a disadvantage that if, in this condition, the vehicle accelerates from its reset condition and comes into a steady-state operation, the air-fuel ratio correction amount is reduced thus deteriorating the acceleration performance and increasing the amount of NOx in the exhaust gas.

SUMMARY OF THE INVENTION

The present invention has been made to overcome the foregoing deficiencies in the prior art and it is an object of this invention to provide an air-fuel ratio control apparatus in which when a vehicle is brought to a stop and the engine comes into an idling operation, the average value of the air-fuel ratio correction amount is decreased by a given amount and the air-fuel ratio control is started again from the said decreased value.

DESCRIPTION OF THE PREFERRED EMBODIMENT

A preferred embodiment of an apparatus according to the invention will now be described with reference to the accompanying drawings.

Figure 1:
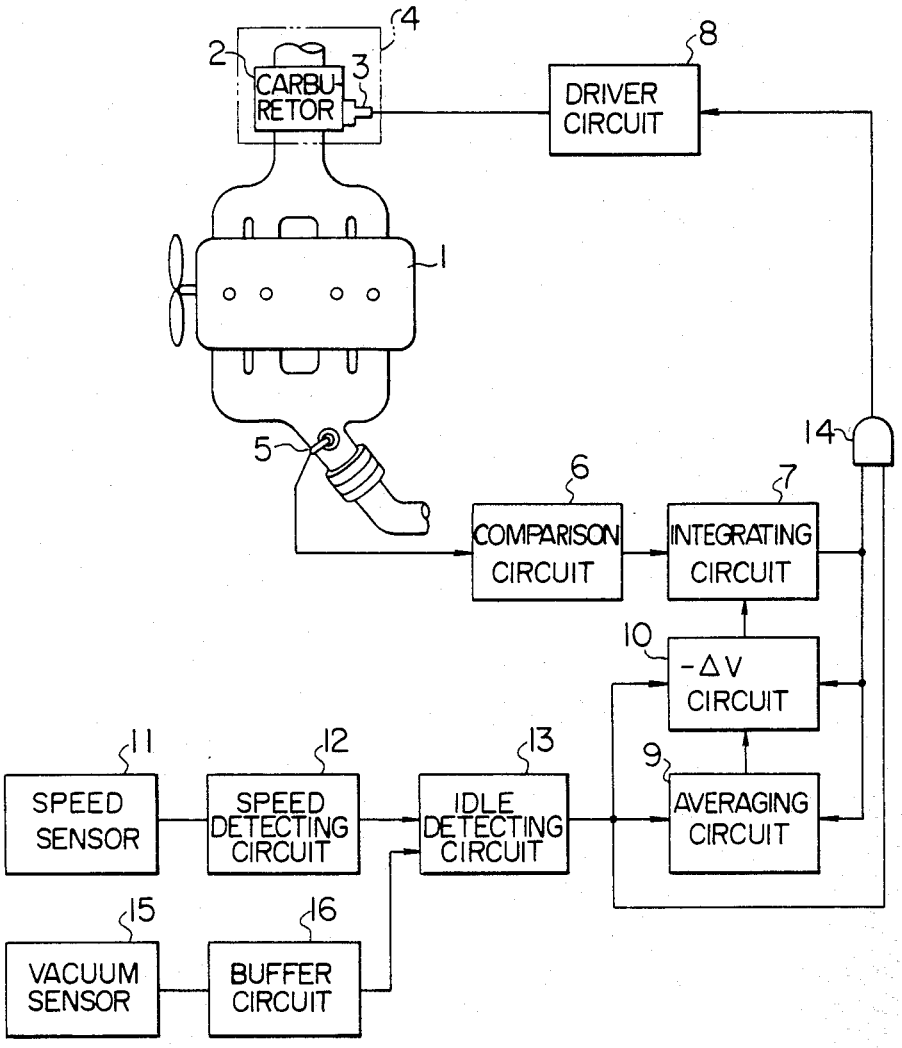
FIG. 1 is a block diagram showing an embodiment of an air-fuel ratio control apparatus according to the invention.

In FIG. 1 showing the overall construction of the embodiment, numeral 1 designates an engine, and 2 a carburetor mounted on the intake air passage of the engine. An actuator 3 is mounted on the carburetor 2 so as to adjust the air-fuel ratio independently of the carburetor throttle valve, and the carburetor 2 and the actuator 3 form a fuel metering unit 4 for controlling the air-fuel ratio of a mixture supplied to the engine 1 through the intake air passage. The actuator 3 includes a linear solenoid valve for varying the amount of bleed air for the carburetor 2 which is supplied to the intake air passage, and the opening and closing of the valve are controlled by the current supplied to the actuator 3 in such a manner that the air-fuel ratio is adjusted leaner when the valve is opened.

Numeral 5 designates an oxygen concentration sensor positioned in the exhaust pipe where the exhaust manifold ducts meet so as to sense the oxygen content of the exhaust gas, 6 a comparison circuit for generating a signal indicative of the difference between the output of the oxygen concentration sensor 5 and a preset value corresponding to a stoichiometric air-fuel ratio, 7 an integrating circuit for generating an integration signal of the difference signal from the comparison circuit 6, and 8 an actuator driver circuit responsive to the integration voltage to control the current supplied to the actuator 3.

Numeral 9 designates an averaging circuit for averaging the integration voltage from the integrating circuit 7 so that the resulting average value is decreased by $-\Delta V$ set by a circuit 10 and the thus decreased voltage is supplied as an initial voltage of the integration voltage when the vehicle comes into an acceleration operation from the idling operation.

Numeral 11 designates an engine speed sensor, and 12 an engine speed detecting circuit for discriminating whether the engine speed is higher or lower than a predetermined value and supplying an output to an idle detecting circuit 13 which determines whether the engine is idling. Numeral 14 designates a gate circuit for stopping the feeding back of the air-fuel ratio when the idle detecting circuit 13 determines that the engine is idling.

Numeral 15 designates a vacuum sensor or switch for detecting the negative pressure in the engine intake system, which is adapted to open its contacts when the negative pressure is high. Numeral 16 designates a buffer circuit for the vacuum switch 15 and the signal from the buffer circuit 16 is supplied as the other input of the idle detecting circuit 13.

Figure 2:
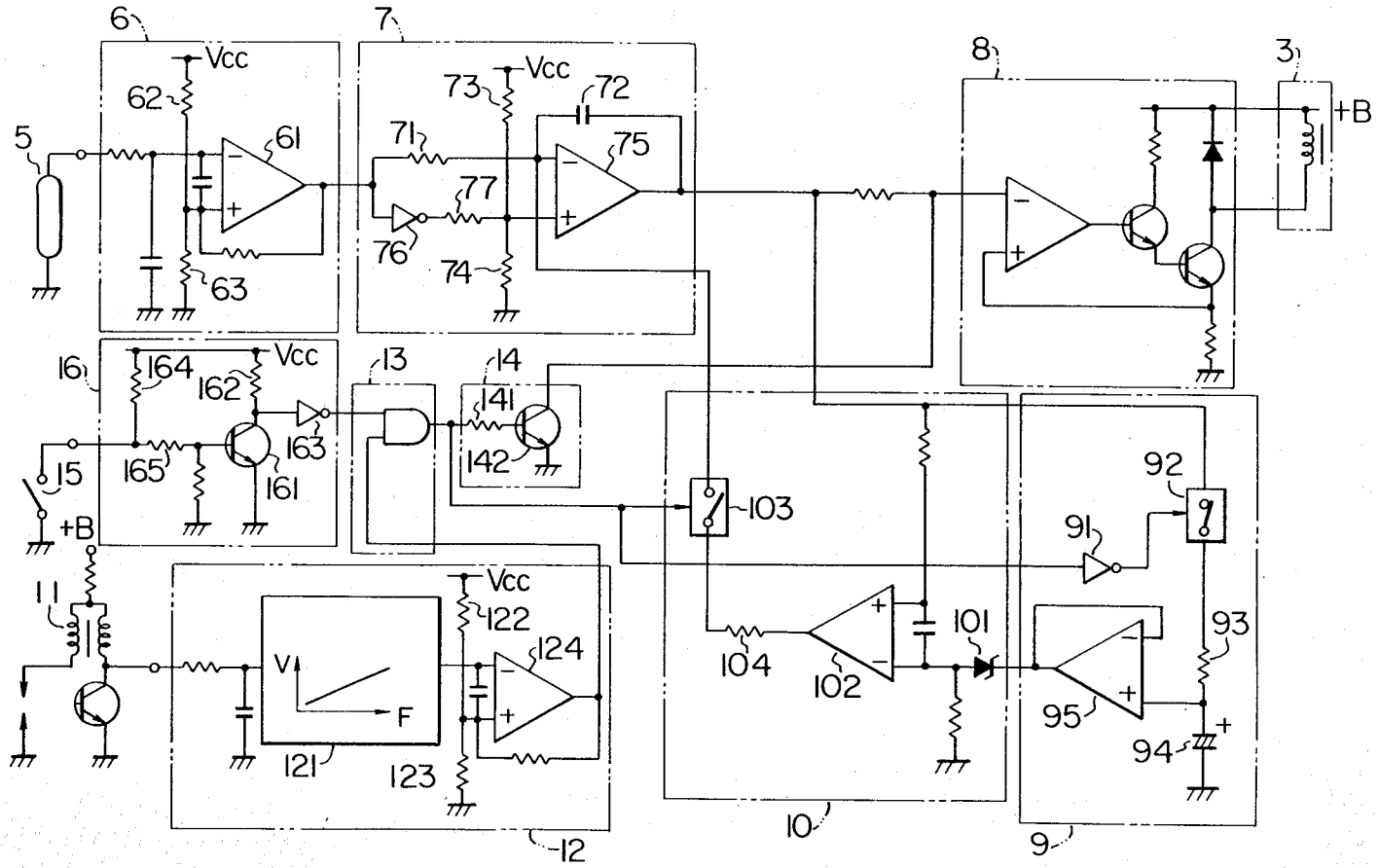
FIG. 2 is a circuit diagram of the air-fuel ratio control apparatus shown in FIG. 1.
Figure 3:
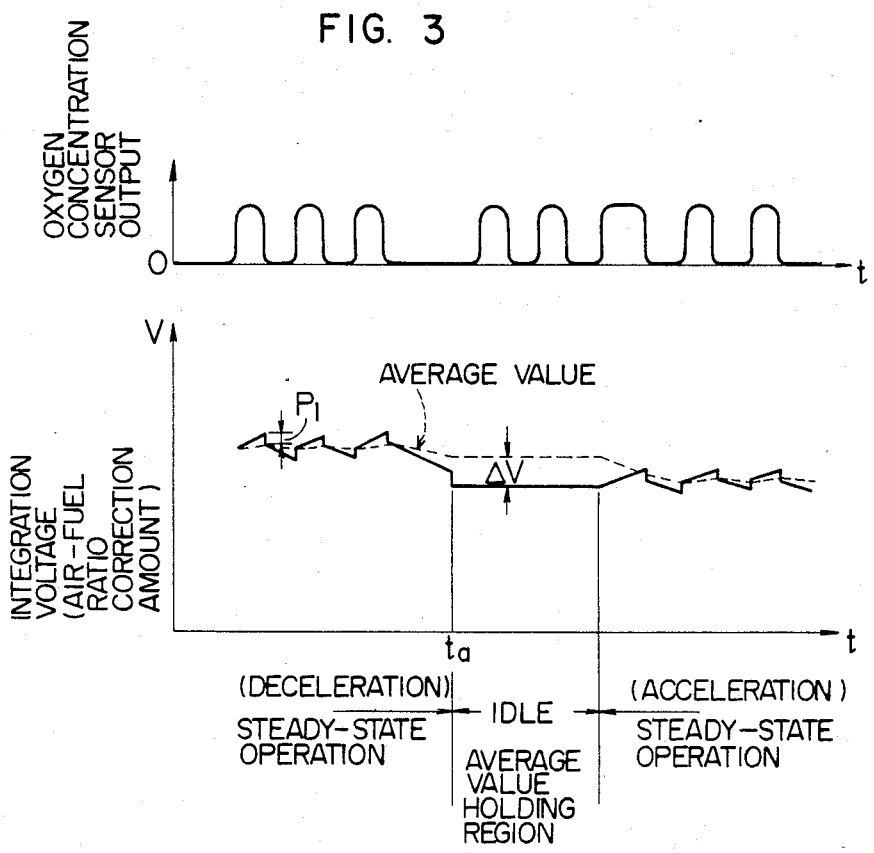
FIG. 3 shows an output waveform of an oxygen concentration sensor and the controlled waveform of an integration voltage which determines an air-fuel ratio correction amount.

FIG. 2 is a circuit diagram for the embodiment of the invention, and FIG. 3 is a time chart for the circuit of FIG. 2.

In the air-fuel ratio comparison circuit 6, the preset voltage corresponding to the stoichiometric air-fuel ratio is applied in the form of the divided voltage of resistors 62 and 63 to the non-inverting input terminal of a comparator 61. Also, the output signal of the oxygen concentration sensor 5 is applied to the inverting input terminal and it is compared with the divided voltage thus generating a different output. When the air-fuel ratio of the exhaust gas is rich, the output of the oxygen concentration sensor 5 goes to a "H" level and thus the output of the air-fuel ratio comparison circuit 6 goes to an "L" level. When the air-fuel ratio of the exhaust gas is lean, the output of the oxygen concentration sensor 5 goes to the "L" level and the output of the air-fuel ratio comparison circuit 6 goes to the "H" level. The integrating circuit 7 receives the output of the air-fuel ratio comparison circuit 6 whereby when the air-fuel ratio of the exhaust gas is rich so that the output of the air-fuel ratio comparison circuit 6 goes to the "L" level, a capacitor 72 is charged through a resistor 71 and the output of the integrating circuit 7 is increased. Thus, the actuator driver circuit 8 supplies a current corresponding to the integration voltage to the actuator 3 so that the actuator 3 is operated in a direction to open and the amount of fleed air is increased thereby adjusting the air-fuel ratio leaner.

When the air-fuel ratio of the exhaust gas is lean, the output of the comparator 61 goes to the "H" level so that the capacitor 72 is charged in the opposite direction through the resistor 71 and the output of the integrating circuit 7 is decreased. Resistors 73 and 74 apply a reference voltage to an operational amplifier 75 and the reference voltage is varied in accordance with the state of the output level of the air-fuel ratio comparison circuit 6 through an inverter 76 and a resistor 77 thereby providing a skip $P_1$ shown in FIG. 3.

Assuming that the vehicle is in the steady-state running condition, the signal from the engine speed sensor 11 is converted to a voltage by an F/V converter 121 and this voltage is higher than a voltage preset by resistors 122 and 123 (usually a voltage corresponding to about 1000 rpm) thus causing the output of a comparator 124 to go to the "L" level. On the other hand, the intake system negative pressure (usually the throttle positioner port pressure) sensed by the vacuum switch 15 is low and the vacuum switch 15 is closed. In the buffer circuit 16, the base of a transistor 161 drops to zero V so that the transistor 161 is turned off and its collector terminal rises to the level of Vcc via a resistor 162 causing the output of an inverter 163 to go to the "L" level. Thus, since the two inputs of the idle detecting circuit 13 are at the "L" level, the input of an inverter 91 of the averaging circuit 9 goes to the "L" level and its output goes to the "H" level. The control terminal of an analog switch 92 goes to the "H" level and the analog switch 92 is turned on. As a result, the integration voltage from the integrating circuit 7 is averaged by the time constant of a resistor 92 and a capacitor 94 and the average voltage of the integration voltage is stored at the positive terminal of the capacitor 94. Numeral 95 designates a voltage follower including an operational amplifier.

The average voltage from the averaging circuit 9 is applied to the cathode terminal of a Zener diode 101 in the $-\Delta V$ circuit 10 so that a voltage of (the average-Vz) is generated at the anode terminal of the Zener diode 101 and this output voltage is lower than the average voltage by a predetermined value.

When the vehicle decelerates from its steadystate operation and then comes into an idling operation as shown at a time $t_a$ in FIG. 3, the engine speed also drops below the speed corresponding to the voltage preset by the resistors 122 and 123 and the output from the comparator 124 of the engine speed detecting circuit 12 goes to the "H" level. Also, the closing of the throttle increases the negative pressure in the intake system (the TP port) and the vacuum switch 15 opens its contacts. As a result, the base of the transistor 161 of the buffer circuit 16 is biased and turned on through base resistors 164 and 165 and its collector voltage goes to the "L" level causing the output of the inverter 163 to go to the "H" level. Thus, the inputs of the idle detecting circuit 13 both go to the "H" level and its output also goes to the "H" level thus detecting the idling condition. In this condition, a transistor 142 of the gate circuit 14 is biased and turned on through a resistor 141 and also the input of the actuator driver circuit 8 is dropped to the "L" level thereby turning off the actuator 3 and stopping the air-fuel ratio control. On the other hand, since the output of the idle detecting circuit 13 is at the "H" level, the output of the inverter 91 of the averaging circuit 9 goes to the "L" level so that the analog switch 92 is turned off and the average voltage attained by the time of the vehicle coming into the idling operation is held in the capacitor 94. This voltage is applied to the inverting input of the comparator 102 through the Zener diode 101 of the $-\Delta V$ circuit 10 and the integration voltage signal is applied to the non-inverting input. As a result, the capacitor 72 is charged through an analog switch 103 and a resistor 104 and the integration voltage is decreased when the output of a comparator 102 goes to the "L" level and the integration voltage is increased when the comparator output goes to the "H" level. In this way, the output of the comparator 102 alternately goes to the "H" level and the "L" level repeatedly and the integration voltage is controlled at (the average voltage $-V_z$). Therefore, when the vehicle is accelerated from the idling condition and comes into a steady-state operation, the transistor 142 of the gate circuit 14 is turned off and the voltage integrated from (the average voltage $-V_z$) is applied to the actuator driver circuit 8. As a result, when the vehicle is brought into a steady-state operation from its unsteady-state operation, the control is started from the correction amount (the integration voltage) which is lower than the average value of the air-fuel ratio correction amount (the integration voltage) during the preceding steady-state operation by the predetermined value.

In accordance with this invention, due to the fact that the air-fuel ratio control apparatus includes the intake pressure detecting circuit for detecting the intake pressure in the engine and generating an intake pressure detection signal in accordance with the intake pressure, the speed detecting circuit for detecting the speed of the engine and comparing the same with a reference value corresponding to a given engine speed to generate a speed detection signal, the idle detecting circuit responsive to the intake pressure detection signal and the speed detection signal to detect an idling condition of the engine and generate an idle detection signal, the air-fuel ratio control halting circuit responsive to the idle detection signal to apply an air-fuel ratio control stop signal to the driver circuit, the average value circuit responsive to the idle detection signal to average the integration voltage and generate an average value voltage, and the average value hold circuit for decreasing the average value voltage by a given value and using the decreased value as an integration initial voltage in response to the engine coming into an acceleration operation from its idling condition, it is possible to improve the acceleration performance and reduce the amount of $NO_x$ in the exhaust gas when the vehicle comes into an acceleration operation from its rest condition.

We claim:

1. An air-fuel ratio control apparatus for an internal combustion engine comprising:

oxygen concentration detecting means for detecting a concentration of oxygen in an exhaust gas from the engine and comparing a detection signal with a reference value corresponding to a stoichiometric air-fuel ratio to generate a difference signal;

integrating means for integrating the difference signal to generate an integration signal;

driver means responsive to the integration signal to control a driving current of air-fuel ratio control means;

intake pressure detecting means for detecting an intake pressure in said engine and generating an intake pressure detection signal in accordance with said intake pressure;

speed detecting means for detecting a rotational speed of said engine and comparing the same with a reference value corresponding to a predetermined engine speed to generate a speed detection signal;

idle detecting means responsive to said intake pressure detection signal and said speed detection signal to detect an idling condition of said engine and generate an idle detection signal;

air-fuel ratio control halting means responsive to said idle detection signal to apply an air-fuel ratio control stop signal to said driver means;

average value means responsive to said idle detection signal to average said integration signal and generate an average value signal; and average value hold means for decreasing said average value signal by a predetermined value and using said decreased value as an integration initial signal when said engine comes into an acceleration operation from said idling condition.

2. An apparatus according to claim 1 wherein said intake pressure detecting means includes a vacuum sensor switch for detecting the negative pressure in the engine and provided to open the contacts thereof when the negative pressure is high.

3. An apparatus according to claim 1 wherein said speed detecting means includes an engine speed sensor, an F/V converter connected to the engine speed sensor to produce a voltage signal proportional to the output signal of said engine speed sensor, and a comparator receiving said voltage signal to generate a low signal when said voltage signal is higher than a reference signal thereof.

4. An apparatus according to claim 1 wherein said idle detecting means includes an AND gate to generate an idle detection signal when said intake pressure detection signal and said speed detection signal are both high levels.

5. An apparatus according to claim 1 wherein said air-fuel ratio control halting means includes a transistor to provide the air-fuel ratio control stop signal when said idle detection signal is applied thereto.

6. An apparatus according to claim 1 wherein said average value means includes an analog switch responsive to said idle detection signal to be closed, a time constant circuit for averaging said integration signal through said analog switch, and a voltage follower operational amplifier receiving the averaged voltage signal to generate said average value signal.

7. An apparatus according to claim 1 wherein said average value hold means includes a Zener diode receiving said average value signal for decreasing said average value signal by a predetermined Zener voltage value, a comparator receiving said decreased signal and said integration signal to generate said integration initial signal, and an analog switch responsive to the output of said idle detecting circuit to apply said integration initial signal to said integrating means.

* * * * *